US011671772B2

(12) United States Patent
Shriner et al.

(10) Patent No.: US 11,671,772 B2
(45) **Date of Patent: *Jun. 6, 2023**

(54) EAR-WORN ELECTRONIC DEVICE INCORPORATING MAGNETICALLY COUPLED FEED FOR AN ANTENNA

(71) Applicant: Starkey Laboratories, Inc., Eden Prairie, MN (US)

(72) Inventors: Paul Anders Shriner, Hopkins, MN (US); Aaron Anderson, Mayer, MN (US); Gregory J. Haubrich, Champlin, MN (US); Nasser Pooladian, St. Paul, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/462,478

(22) Filed: Aug. 31, 2021

(65) Prior Publication Data

US 2022/0021989 A1 Jan. 20, 2022

Related U.S. Application Data

(63) Continuation of application No. 16/371,495, filed on Apr. 1, 2019, now Pat. No. 11,122,376.

(51) Int. Cl.
*H04R 25/00* (2006.01)
*H01Q 1/27* (2006.01)

(52) U.S. Cl.
CPC ..... *H04R 25/554* (2013.01); *H01Q 1/273* (2013.01); *H04R 2225/51* (2013.01)

(58) Field of Classification Search
CPC .. H04R 25/554; H04R 2225/51; H04R 25/65; H01Q 1/273
See application file for complete search history.

(56) References Cited

U.S. PATENT DOCUMENTS 6,292,153 B1 9/2001 Aiello et al.
7,593,538 B2 * 9/2009 Polinske ..... H01Q 7/00 381/322

(Continued)

FOREIGN PATENT DOCUMENTS

EP 2076065 7/2009
EP 2723101 6/2014

(Continued)

OTHER PUBLICATIONS

European Search Report for Application No. 20164420.0 dated Sep. 8, 2020 (8 pages).

(Continued)

*Primary Examiner* — Oyesola C Ojo
(74) *Attorney, Agent, or Firm* — Mueting Raasch Group

(57) ABSTRACT

Embodiments are directed to an ear-worn electronic device configured to be worn by a wearer. The device comprises an enclosure configured to be supported at, by, in or on the wearer's ear. A processor is disposed in the enclosure. A speaker or a receiver is coupled to the processor. A radio frequency transceiver is disposed in the enclosure and coupled to the processor. An antenna is disposed in or on the enclosure. A magnetically coupled feed arrangement comprises a separable transformer. The separable transformer comprises a first coil coupled to the antenna and a second coil coupled to the transceiver, wherein the second coil is physically and electrically separated from the first coil. The feed arrangement is configured to feed the antenna via mutual inductance between the first and second coils.

19 Claims, 11 Drawing Sheets

(56) References Cited

U.S. PATENT DOCUMENTS

| | | | | |
|---|---|---|---|---|
| 7,742,614 | B2 * | 6/2010 | Christensen | H04R 25/602 320/108 |
| 8,878,735 | B2 | 11/2014 | Kvist et al. | |
| 9,191,757 | B2 * | 11/2015 | Bauman | H04R 25/48 |
| 9,237,404 | B2 * | 1/2016 | Ozden | H04R 25/55 |
| 9,397,399 | B2 | 7/2016 | Pajona et al. | |
| 9,432,779 | B2 | 8/2016 | Kerselaers | |
| 9,554,219 | B2 | 1/2017 | Kvist | |
| 9,577,348 | B2 | 2/2017 | Gomme et al. | |
| 9,635,475 | B2 | 4/2017 | Polinske et al. | |
| 9,661,427 | B2 | 5/2017 | Bauman et al. | |
| 9,729,979 | B2 * | 8/2017 | Özden | H04R 25/554 |
| 9,819,097 | B2 | 11/2017 | Kerselaers et al. | |
| 9,888,327 | B2 | 2/2018 | Nikles et al. | |
| 9,906,879 | B2 | 2/2018 | Prchal et al. | |
| 9,913,052 | B2 | 3/2018 | Dzarnoski et al. | |
| 9,973,864 | B2 | 5/2018 | Henriksen et al. | |
| 10,165,376 | B2 | 12/2018 | Vajha et al. | |
| 10,320,086 | B2 | 6/2019 | Kerselaers et al. | |
| 10,321,248 | B2 * | 6/2019 | Thaysen | H04R 25/554 |
| 10,349,192 | B2 | 7/2019 | Pooladian et al. | |
| 10,448,173 | B2 | 10/2019 | Hesselballe et al. | |
| 10,595,138 | B2 | 3/2020 | Pinto | |
| 11,011,845 | B2 | 5/2021 | Flood et al. | |
| 2005/0099341 | A1 | 5/2005 | Zhang et al. | |
| 2009/0169038 | A1 * | 7/2009 | Knudsen | H04R 25/558 381/315 |
| 2013/0307740 | A1 * | 11/2013 | Pajona | H01Q 5/307 343/866 |
| 2013/0342407 | A1 * | 12/2013 | Kvist | H01Q 13/10 343/718 |
| 2013/0343586 | A1 | 12/2013 | Kvist et al. | |
| 2015/0036854 | A1 * | 2/2015 | Polinske | H01Q 1/273 381/315 |
| 2016/0050501 | A1 * | 2/2016 | Pinto | H04R 25/554 381/315 |
| 2016/0330552 | A1 | 11/2016 | Flood | |
| 2016/0381471 | A1 * | 12/2016 | Henriksen | H04R 25/554 381/315 |
| 2017/0026762 | A1 * | 1/2017 | Ruaro | H01Q 1/521 |
| 2017/0062949 | A1 * | 3/2017 | Kerselaers | H01Q 21/0006 |
| 2017/0064466 | A1 * | 3/2017 | Pooladian | H04R 25/60 |
| 2017/0094386 | A1 * | 3/2017 | Trainer | H04R 1/1016 |
| 2017/0250728 | A1 * | 8/2017 | Afsahi | H04B 1/44 |
| 2018/0124528 | A1 * | 5/2018 | Polinske | H04R 25/602 |
| 2019/0116431 | A1 * | 4/2019 | Hesselballe | H01Q 7/00 |
| 2020/0077210 | A1 * | 3/2020 | Polinske | H04R 25/609 |
| 2021/0187293 | A1 * | 6/2021 | Friedling | A61N 1/36036 |

FOREIGN PATENT DOCUMENTS

| | | |
|---|---|---|
| EP | 2765650 | 8/2014 |
| EP | 2985834 | 2/2016 |
| EP | 3094111 | 11/2016 |
| EP | 3316598 | 5/2018 |
| JP | 0653859 | 2/1994 |

OTHER PUBLICATIONS

European Office Action for Application No. 20164420.0 dated Mar. 2, 2022 (6 pages).

* cited by examiner

EAR-WORN ELECTRONIC DEVICE INCORPORATING MAGNETICALLY COUPLED FEED FOR AN ANTENNA

RELATED PATENT DOCUMENTS

This application is a continuation of U.S. patent application Ser. No. 16/371,495, filed Apr. 1, 2019, which is incorporated herein by reference in its entirety.

TECHNICAL FIELD

This application relates generally to ear-worn electronic devices, including hearing devices, hearing aids, personal amplification devices, and other hearables.

BACKGROUND

Hearing devices provide sound for the wearer. Some examples of hearing devices are headsets, hearing aids, speakers, cochlear implants, bone conduction devices, and personal listening devices. For example, hearing aids provide amplification to compensate for hearing loss by transmitting amplified sounds to a wearer's ear canals. Hearing devices may be capable of performing wireless communication with other devices, such as receiving streaming audio from a streaming device via a wireless link. Wireless communication may also be performed for programming the hearing device and transmitting information from the hearing device. For performing such wireless communication, hearing devices such as hearing aids can include a wireless transceiver and an antenna.

SUMMARY

Embodiments are directed to an ear-worn electronic device configured to be worn by a wearer. The device comprises an enclosure configured for at least partial insertion into an ear canal of the wearer. The enclosure comprises a preformed shape or a shapeable material that conforms to a shape of the wearer's ear canal. The enclosure also comprises a faceplate and a battery door supported by and movable relative to the faceplate. A processor is disposed in the enclosure. A speaker or a receiver is operably coupled to the processor. A radio frequency transceiver is disposed in the enclosure and operably coupled to the processor. An antenna is supported by or integral to the battery door. A magnetically coupled feed arrangement comprises a separable transformer. The separable transformer comprises a first coil coupled to the antenna and supported by the battery door, and a second coil coupled to the transceiver and supported by the faceplate, a structure of or within the enclosure or a component in the enclosure. A conductor of the second coil is physically and electrically separated from a conductor of the first coil. The feed arrangement is configured to feed the antenna via mutual inductance between the first and second coils.

Embodiments are directed to an ear-worn electronic device configured to be worn by a wearer. The device comprises an enclosure configured for at least partial insertion into an ear canal of the wearer. The enclosure comprises a faceplate and a shell having a preformed shape or comprising a shapeable material that conforms to a shape of the wearer's ear canal. A processor is disposed in the enclosure. A speaker or a receiver is operably coupled to the processor. A radio frequency transceiver is disposed in the enclosure and operably coupled to the processor. An antenna is supported by or integral to the faceplate. The antenna comprises a radiating element, a ground plane, and a substrate comprising dielectric material disposed between the radiating element and the ground plane. A magnetically coupled feed arrangement comprises a separable transformer. The separable transformer comprises a first coil coupled to the antenna and supported by the faceplate, and a second coil coupled to the transceiver and supported by the faceplate, a structure of or within the shell or a component in the shell. A conductor of the second coil is physically and electrically separated from a conductor of the first coil. The feed arrangement is configured to feed the antenna via mutual inductance between the first and second coils.

Embodiments are directed to an ear-worn electronic device configured to be worn by a wearer. The device comprises an enclosure configured to be supported at, by, in or on the wearer's ear. A processor is disposed in the enclosure. A speaker or a receiver is coupled to the processor. A radio frequency transceiver is disposed in the enclosure and coupled to the processor. An antenna is disposed in or on the enclosure. A magnetically coupled feed arrangement comprises a separable transformer. The separable transformer comprises a first coil coupled to the antenna and a second coil coupled to the transceiver, wherein a conductor of the second coil is physically and electrically separated from a conductor of the first coil. The feed arrangement is configured to feed the antenna via mutual inductance between the first and second coils The above summary is not intended to describe each disclosed embodiment or every implementation of the present disclosure. The figures and the detailed description below more particularly exemplify illustrative embodiments.

BRIEF DESCRIPTION OF THE DRAWINGS

Throughout the specification reference is made to the appended drawings wherein.

The figures are not necessarily to scale. Like numbers used in the figures refer to like components. However, it will be understood that the use of a number to refer to a component in a given figure is not intended to limit the component in another figure labeled with the same number.

DETAILED DESCRIPTION

Figure 1A:
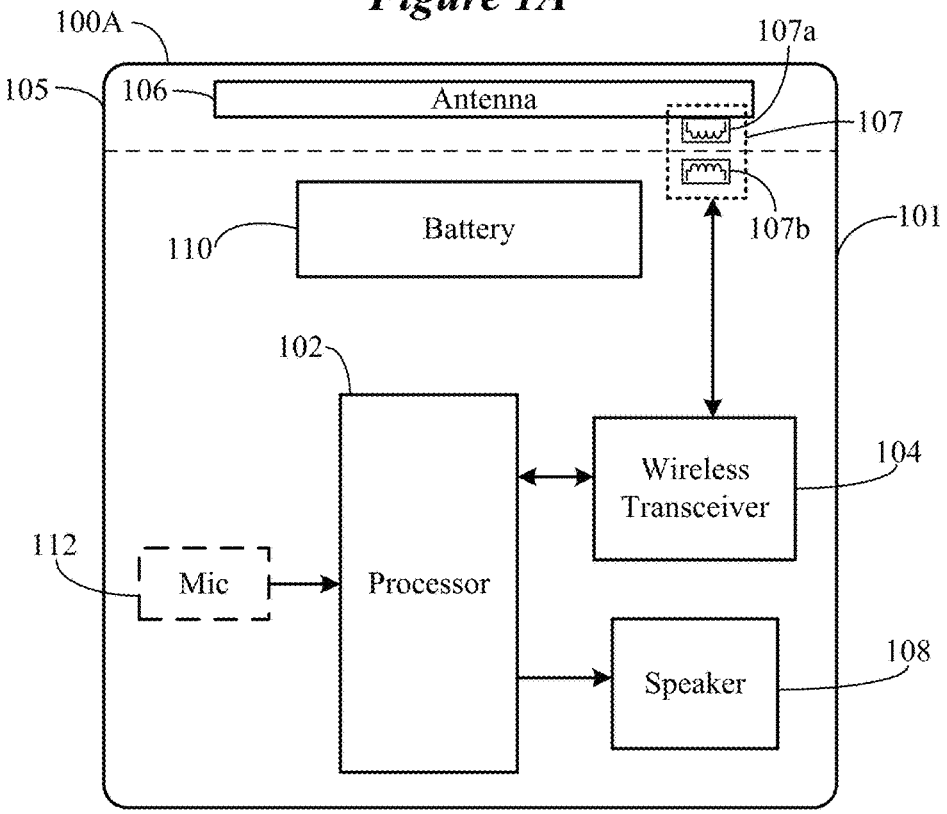
FIGS. 1A and 1B illustrate an ear-worn electronic device arrangement incorporating a magnetically coupled feed for an antenna of the device in accordance with any of the embodiments disclosed herein.

It is understood that the embodiments described herein may be used with any ear-worn or ear-level electronic device without departing from the scope of this disclosure. The devices depicted in the figures are intended to demonstrate the subject matter, but not in a limited, exhaustive, or exclusive sense. Ear-worn electronic devices (also referred to herein as "hearing devices"), such as hearables (e.g., wearable earphones, ear monitors, and earbuds), hearing aids, hearing instruments, and hearing assistance devices, typically include an enclosure, such as a housing or shell, within which internal components are disposed. Typical components of a hearing device can include a processor (e.g., a digital signal processor or DSP), memory circuitry, power management circuitry, one or more communication devices (e.g., a radio, a near-field magnetic induction (NFMI) device), one or more antennas, one or more microphones, and a receiver/speaker, for example. Hearing devices can incorporate a long-range communication device, such as a Bluetooth® transceiver or other type of radio frequency (RF) transceiver. A communication device (e.g., a radio or NFMI device) of a hearing device can be configured to facilitate communication between a left ear device and a right ear device of the hearing device.

Hearing devices of the present disclosure can incorporate an antenna coupled to a high-frequency transceiver, such as a 2.4 GHz radio. The RF transceiver can conform to an IEEE 802.11 (e.g., WiFi®) or Bluetooth® (e.g., BLE, Bluetooth® 4.2 or 5.0) specification, for example. It is understood that hearing devices of the present disclosure can employ other transceivers or radios, such as a 900 MHz radio. Hearing devices of the present disclosure can be configured to receive streaming audio (e.g., digital audio data or files) from an electronic or digital source. Representative electronic/digital sources (e.g., accessory devices) include an assistive listening system, a TV streamer, a radio, a smartphone, a laptop, a cell phone/entertainment device (CPED) or other electronic device that serves as a source of digital audio data or other types of data files. Hearing devices of the present disclosure can be configured to effect bi-directional communication (e.g., wireless communication) of data with an external source, such as a remote server via the Internet or other communication infrastructure. Hearing devices that include a left ear device and a right ear device can be configured to effect bi-directional communication (e.g., wireless communication) therebetween, so as to implement ear-to-ear communication between the left and right ear devices.

The term hearing device of the present disclosure refers to a wide variety of ear-level electronic devices that can aid a person with impaired hearing. The term hearing device also refers to a wide variety of devices that can produce processed sound for persons with normal hearing. Hearing devices of the present disclosure include hearables (e.g., wearable earphones, headphones, earbuds, virtual reality headsets), hearing aids (e.g., hearing instruments), cochlear implants, and bone-conduction devices, for example. Hearing devices include, but are not limited to, behind-the-ear (BTE), in-the-ear (ITE), in-the-canal (ITC), invisible-in-canal (IIC), receiver-in-canal (RIC), receiver-in-the-ear (RITE) or completely-in-the-canal (CIC) type hearing devices or some combination of the above. Throughout this disclosure, reference is made to a "hearing device," which is understood to refer to a system comprising a single left ear device, a single right ear device, or a combination of a left ear device and a right ear device.

Ear-worn electronic devices configured for wireless communication, such as hearing aids and other types of hearing devices, can be relatively small in size. Custom hearing devices, such as ITE, ITC, and CIC devices for example, are quite small in size. In the manufacture of a custom hearing device, for example, an ear impression or ear mold is taken for a particular wearer and processed to construct the housing of the hearing device. Because custom hearing devices are designed to be partially or fully inserted into a wearer's ear canal, the housing is necessarily quite small. In order to implement a functional wireless platform (e.g., @ 2.4 GHz), the antenna must be small enough to fit within such devices. The severe space limitations within the housing of an ear-worn electronic device impose a physical challenge on designing the antenna.

For some hearing devices, it is desirable to mount the antenna on a movable door or drawer which is used to insert and remove a battery into/from the hearing device. Mounting the antenna to the movable battery door of relatively small hearing devices, such as custom hearing aids, provides the opportunity to significantly reduce the size of the hearing device.

However, feeding the antenna in this location presents a unique challenge, since the feed cannot have a soldered physical connection. This is particularly important in order for the battery door to be field replaceable, which is highly desirable for some hearing devices. One approach to implementing an antenna arrangement with a connection-less feed involves the use of scratch pads, which would likely shorten the life of the hearing device by an unacceptable degree. Scratch pads can also negatively impact the antenna performance at high frequencies (e.g., @ 2.4 GHz).

Embodiments of the disclosure are directed to an antenna arrangement of a hearing device which includes a magnetically coupled feed for the antenna. A magnetically coupled feed for the antenna of a hearing device eliminates the need for a physical (e.g., soldered) connection between the antenna and a transceiver (e.g., via a matching network) of the hearing device. A magnetically coupled feed for the antenna of a hearing device provides the flexibility of mounting different components of the antenna arrangement on different structures or components of the hearing device. For example, some components of the antenna arrangement can be mounted on a fixed structure of the hearing device, while other antenna components can be mounted on a movable structure of the hearing device. More particularly, the antenna and a first section of the feed arrangement can be mounted on a movable structure of the hearing device. A second section of the feed arrangement is coupled to a transceiver, and can be mounted on a fixed (or, alternatively, a movable) structure of the hearing device. When moved into close proximity to one another, such as by moving the movable structure into proximity to the fixed structure, the first and second feed sections serve as a magnetically coupled feed for the antenna.

According to any of the embodiments disclosed herein, a magnetically coupled feed arrangement comprises at least a first section and a second section, such that a conductor of the first section is physically and electrically separated from a conductor of the second section. More particularly, a conductor of the first section is not electrically (as opposed to magnetically or electromagnetically) connected to a conductor of the second section, such that the conductors (e.g., metal components) of the first and section sections are not in physical (e.g., mechanical) contact with one another. It is understood that conductors of the first and/or second sections can be covered by thin insulating material (e.g., polyimide), and this insulating material can be in physical contact, while the conductors (e.g., metal components) of the first and second sections remain physically separated from one another (e.g., no metal-to-metal contact between the first and second sections).

Figure 1B:
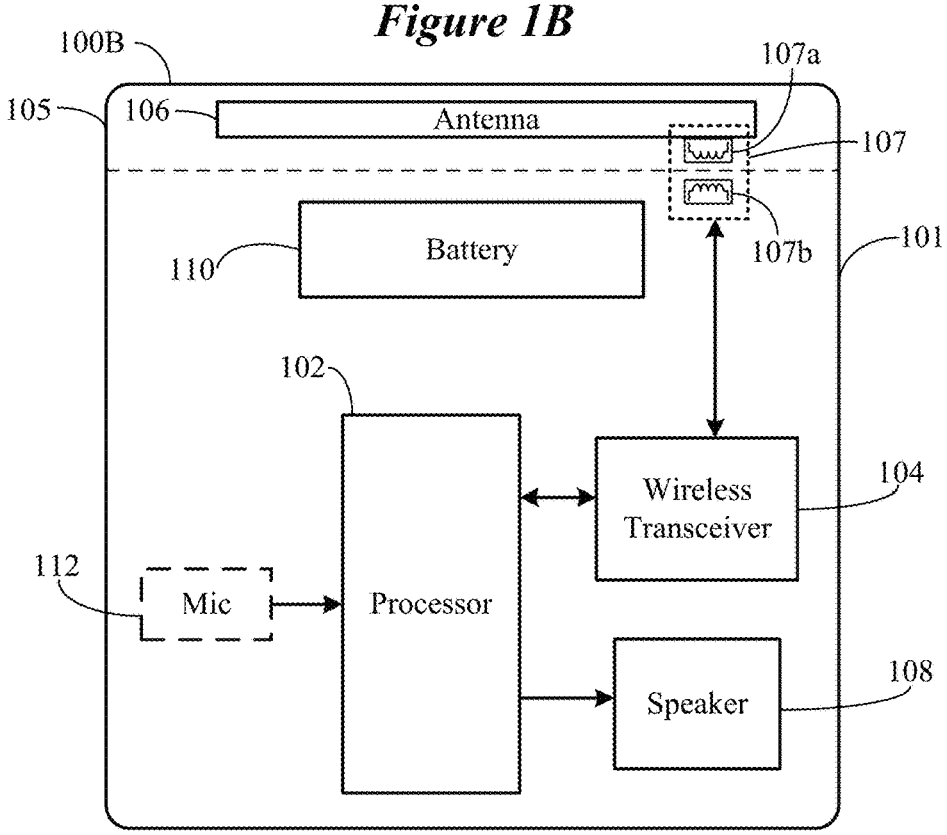

FIGS. 1A and 1B illustrate various components of a representative hearing device arrangement in accordance with any of the embodiments disclosed herein. FIGS. 1A and 1B illustrate first and second hearing devices 100A and 100B configured to be supported at, by, in or on left and right ears of a wearer. In some embodiments, a hearing device arrangement includes a single hearing device 100A or 100B which can be supported at, by, in or on the left or right ear of a wearer. As illustrated, the first and second hearing devices 100A and 100B include the same functional components. It is understood that the first and second hearing devices 100A and 100B can include different functional components. The first and second hearing devices 100A and 100B can be representative of any of the hearing devices disclosed herein.

The first and second hearing devices 100A and 100B include an enclosure 101 configured for placement, for example, over or on the ear, entirely or partially within the external ear canal (e.g., between the pinna and ear drum) or behind the ear. Disposed within the enclosure 101 is a processor 102 which incorporates or is coupled to memory circuitry. The processor 102 can include or be implemented as a multi-core processor, a digital signal processor (DSP), an audio processor or any combination of these processors. For example, the processor 102 may be implemented in a variety of different ways, such as with a mixture of discrete analog and digital components that include a processor configured to execute programmed instructions contained in a processor-readable storage medium (e.g., solid-state memory, e.g., Flash).

The processor 102 is coupled to a wireless transceiver 104 (also referred to herein as a radio), such as a BLE transceiver. The wireless transceiver 104 is operably coupled to an antenna 106 configured for transmitting and receiving radio signals. The antenna 106, according to any of the embodiments disclosed herein, is mounted to a movable (e.g., separable, removable) section 105 of the enclosure or shell 101. The movable section 105 can be a plate (e.g., a faceplate) that covers a major opening of the shell of the enclosure 101. For example, the faceplate can be attached to the shell during hearing device assembly. The faceplate is typically a structure separate from the shell and is not designed to be separable by the wearer. By way of further example, the movable section 105 can be a battery door or drawer of a faceplate of the enclosure 101. In such a configuration, the faceplate is fixed to the shell of the enclosure 101 and the antenna 106 travels with the battery door as the battery door is moved into and out of the faceplate (see, e.g., FIGS. 4A-4C). In some configurations, the faceplate and/or the battery door assembly can be a field replaceable component.

The antenna 106 is operably coupled to the wireless transceiver 104 by a magnetically coupled feed arrangement 107. The wireless transceiver 104 can include or be coupled to a matching network, and the matching network can be coupled to the magnetically coupled feed arrangement 107. The magnetically coupled feed arrangement 107 comprises multiple coupling elements. At least one of the coupling elements is mounted on or supported by the movable section 105 of the enclosure 101, and at least one other coupling element is mounted on or supported by a structure (e.g., a flexible electrical circuit, a spine structure, an enclosure wall) of the fixed portion (e.g., shell) of the enclosure 101.

According to any of the embodiments disclosed herein, the magnetically coupled feed arrangement 107 comprises a separable transformer, such that elements of the transformer are movable relative to one another. For example, the separable transformer can include a first coupling element 107*a* supported on or by the movable section 105 of the enclosure 101. A second coupling element 107*b* can be mounted on or supported by a structure of the fixed portion of the enclosure 101. The magnetically coupled feed arrangement 107 is configured to feed the antenna 106 via mutual inductance between the first and second coupling elements 107*a*, 107*b*. Provision of separable first and second coupling elements 107*a*, 107*b* of the magnetically coupled feed arrangement 107 eliminates a physical connection between the antenna 106 and the transceiver 104 (or a matching network), allowing the antenna 106 to be mounted on a movable section 105 of the enclosure 101.

In some embodiments, the hearing devices 100A and 100B need not include a movable section 105. In such embodiments, the antenna 106 can be mounted on or within the enclosure 101 and coupled to the transceiver 104 via the magnetically coupled feed arrangement 107. For example, the antenna 106 can be implemented on a laser direct structuring (LD S) structure one or inside of the enclosure 101. By way of further examples, the antenna 106 can be integrated into the spine or a flexible electrical circuit disposed within the enclosure 101. In each of these embodiments, the antenna 106 is coupled to the transceiver 104 via the magnetically coupled feed arrangement 107, which need not include a separable transformer.

The wireless transceiver 104 and antenna 106 can be configured to enable ear-to-ear communication between the two hearing devices 100A and 100B, as well as communications with an external device (e.g., a smartphone or a digital music player). A battery 110 or other power source (rechargeable or conventional) is provided within the enclosure 101 and configured to provide power to the various components of the hearing devices 100A and 100B. In some embodiments, the battery 110 can be inserted into and removed from the enclosure 101 via a battery door or drawer. A speaker or receiver 108 is coupled to an amplifier (not shown) and the processor 102. The speaker or receiver 108 is configured to generate sound which is communicated to the wearer's ear.

In some embodiments, the hearing devices 100A and 100B include a microphone 112 mounted on or inside the enclosure 101. The microphone 112 may be a single microphone or multiple microphones, such as a microphone array. The microphone 112 can be coupled to a preamplifier (not shown), the output of which is coupled to the processor 102. The microphone 112 receives sound waves from the environment and converts the sound into an input signal. The input signal is amplified by the preamplifier and sampled and digitized by an analog-to-digital converter of the processor 102, resulting in a digitized input signal. In some embodiments (e.g., hearing aids), the processor 102 (e.g., DSP circuitry) is configured to process the digitized input signal into an output signal in a manner that compensates for the wearer's hearing loss. When receiving an audio signal from an external source, the wireless transceiver 104 may produce a second input signal for the DSP circuitry of the processor 102 that may be combined with the input signal produced by the microphone 112 or used in place thereof. In other embodiments, (e.g., hearables), the processor 102 can be configured to process the digitized input signal into an output signal in a manner that is tailored or optimized for the wearer (e.g., based on wearer preferences). The output signal is then passed to an audio output stage that drives the speaker or receiver 108, which converts the output signal into an audio output.

Some embodiments are directed to a custom hearing aid, such as an ITC, CIC, or IIC hearing aid. For example, some embodiments are directed to a custom hearing aid which includes a wireless transceiver and an antenna arrangement configured to operate in the 2.4 GHz ISM frequency band or other applicable communication band (referred to as the "Bluetooth® band" herein). As was discussed previously, creating a robust antenna arrangement for a 2.4 GHz custom hearing aid represents a significant engineering challenge. A custom hearing aid is severely limited in space. Provision of the magnetically coupled feed arrangement 107 allows the antenna 106 to be mounted on the movable battery door 105, which provides for a significant reduction in the overall size of the hearing device enclosure 101 while delivering good antenna performance.

Figure 2A:
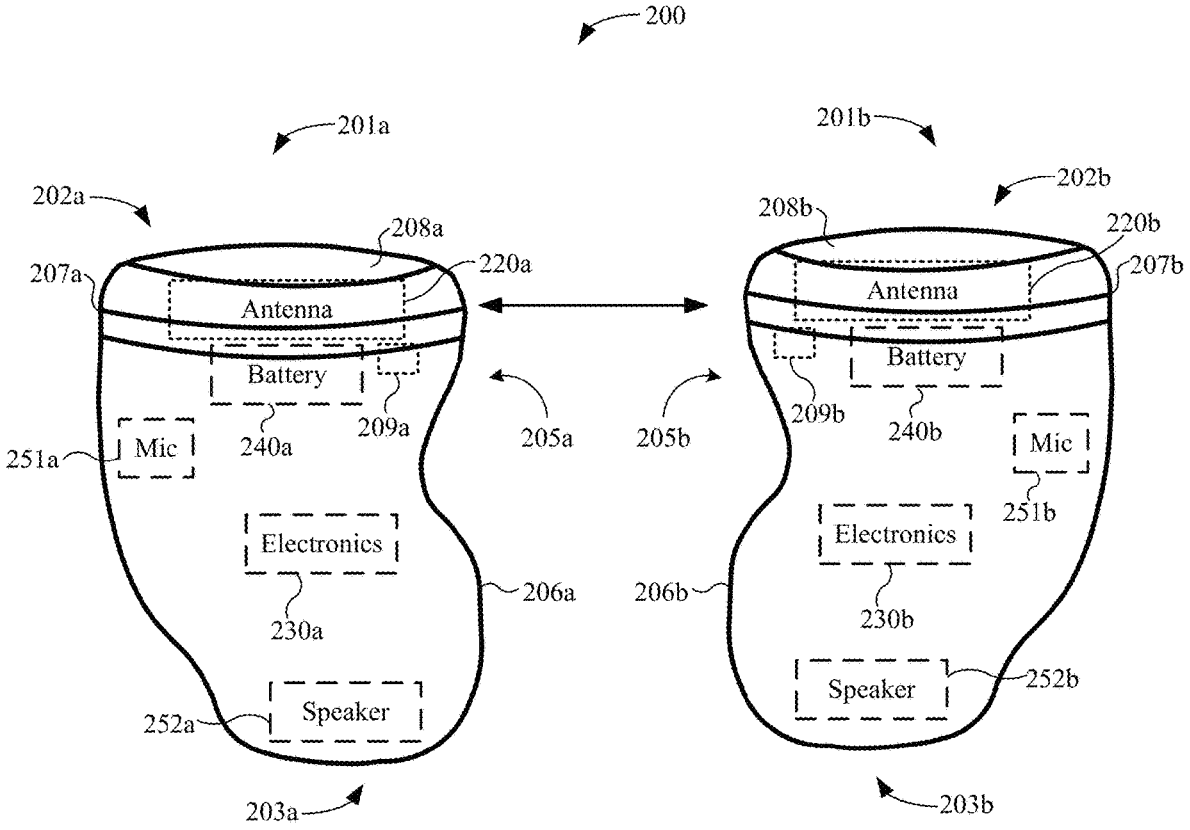
FIGS. 2A and 2B illustrate a custom hearing device system which incorporates a magnetically coupled feed for an antenna of the device in accordance with any of the embodiments disclosed herein.
Figure 2B:
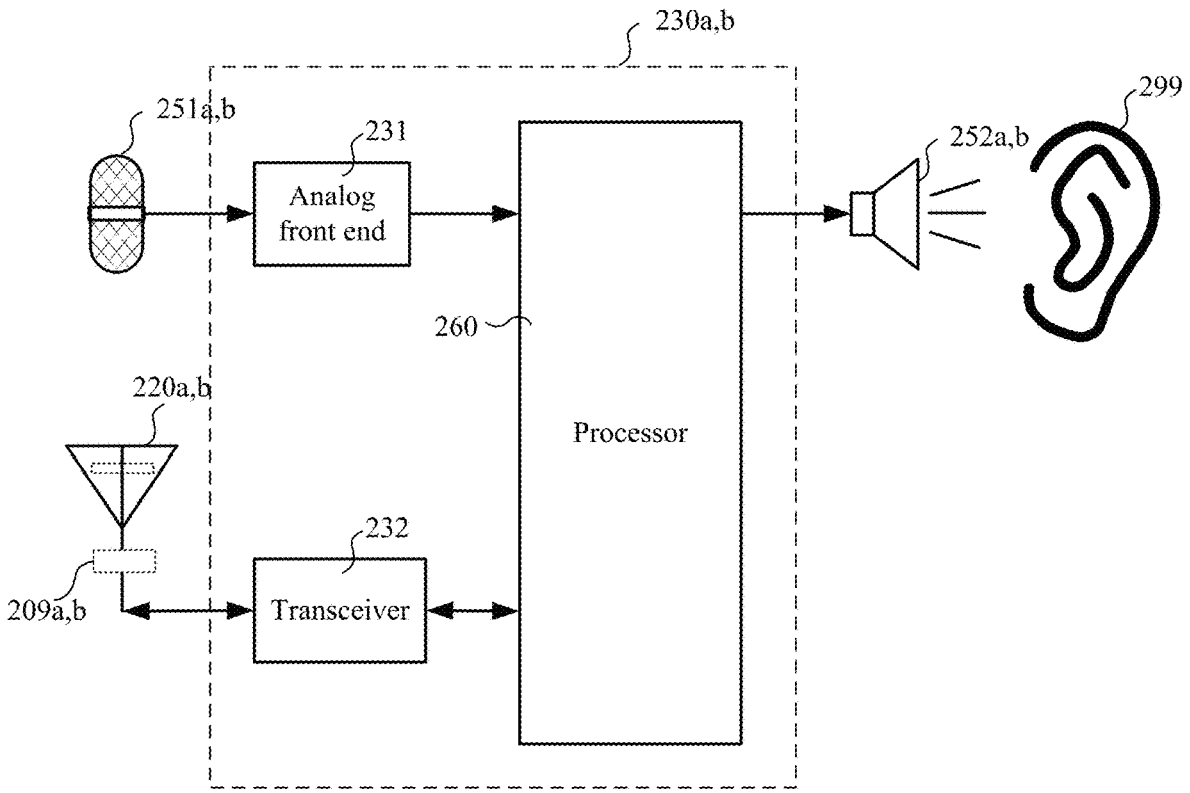

FIGS. 2A and 2B illustrate a custom hearing aid system which incorporates an antenna and a magnetically coupled feed arrangement in accordance with any of the embodiments disclosed herein. The hearing aid system 200 shown in FIGS. 2A and 2B includes two hearing devices, e.g., left 201*a* and right 201*b* side hearing devices, configured to wirelessly communicate with each other and external devices and systems. FIG. 2A conceptually illustrates functional blocks of the hearing devices 201*a*, 201*b*. The position of the functional blocks in FIG. 2A does not necessarily indicate actual locations of components that implement these functional blocks within the hearing devices 201*a*, 201*b*. FIG. 2B is a block diagram of components that may be disposed at least partially within the enclosure 205*a*, 205*b* of the hearing device 201*a*, 201*b*.

Each hearing device 201*a*, 201*b* includes a physical enclosure 205*a*, 205*b* that encloses an internal volume. The enclosure 205*a*, 205*b* is configured for at least partial insertion within the wearer's ear canal. The enclosure 205*a*, 205*b* includes an external side 202*a*, 202*b* that faces away from the wearer and an internal side 203*a*, 203*b* that is inserted in the ear canal. The enclosure 205*a*, 205*b* comprises a shell 206*a*, 206*b* and a faceplate 207*a*, 207*b*. The shell 206*a*, 206*b* typically has a shape that is customized to the shape of a particular wearer's ear canal (e.g., based on an ear mold taken for the particular wearer). In some embodiments, the shell 206*a*, 206*b* can be a semi-custom shell formed from soft conforming material that assumes the shape of a wearer's ear canal when inserted. The faceplate 207*a*, 207*b* may include a battery door 208*a*, 208*b* or drawer disposed near the external side 202*a*, 202*b* of the enclosure 205*a*, 205*b* and configured to allow the battery 240*a*, 240*b* to be inserted and removed from the enclosure 205*a*, 205*b*. The battery 240*a*, 240*b* powers electronic circuitry 230*a*, 230*b* which is also disposed within the shell 206*a*, 206*b*. An antenna 220*a*, 220*b* can be mounted on the faceplate 207*a*, 207*b* or, more particularly, to the battery door 208*a*, 208*b*. A magnetically coupled feed arrangement 209*a*, 209*b* facilitates connection-less coupling between the antenna 220*a*, 220*b* and a transceiver 232 (e.g., via a matching network) of the electronic circuitry 230*a*, 230*b*.

As illustrated in FIGS. 2A and 2B, the hearing device 201*a*, 201*b* may include one or more microphones 251*a*, 251*b* configured to pick up acoustic signals and to transduce the acoustic signals into microphone electrical signals. The electrical signals generated by the microphones 251*a*, 251*b* may be conditioned by an analog front end 231 (see FIG. 2B) by filtering, amplifying and/or converting the microphone electrical signals from analog to digital signals so that the digital signals can be further processed and/or analyzed by the processor 260. The processor 260 may perform signal processing and/or control various tasks of the hearing device 201*a*, 201*b*. In some implementations, the processor 260 comprises a DSP that may include additional computational processing units operating in a multi-core architecture.

The processor 260 is configured to control wireless communication between the hearing devices 201*a*, 201*b* and/or an external accessory device (e.g., a smartphone, a digital music player) via the antenna 220*a*, 220*b* and transceiver 232. The wireless communication may include, for example, audio streaming data and/or control signals. The transceiver 232 has a receiver portion that receives communication signals from the antenna 220*a*, 220*b*, demodulates the communication signals, and transfers the signals to the processor 260 for further processing. The transceiver 232 also includes a transmitter portion that modulates output signals from the processor 260 for transmission via the antenna 220*a*, 220*b*. Electrical signals from the microphone 251*a*, 251*b* and/or wireless communication received via the antenna 220*a*, 220*b* may be processed by the processor 260 and converted to acoustic signals played to the wearer's ear 299 via a speaker 252*a*, 252*b*.

Figure 3A:
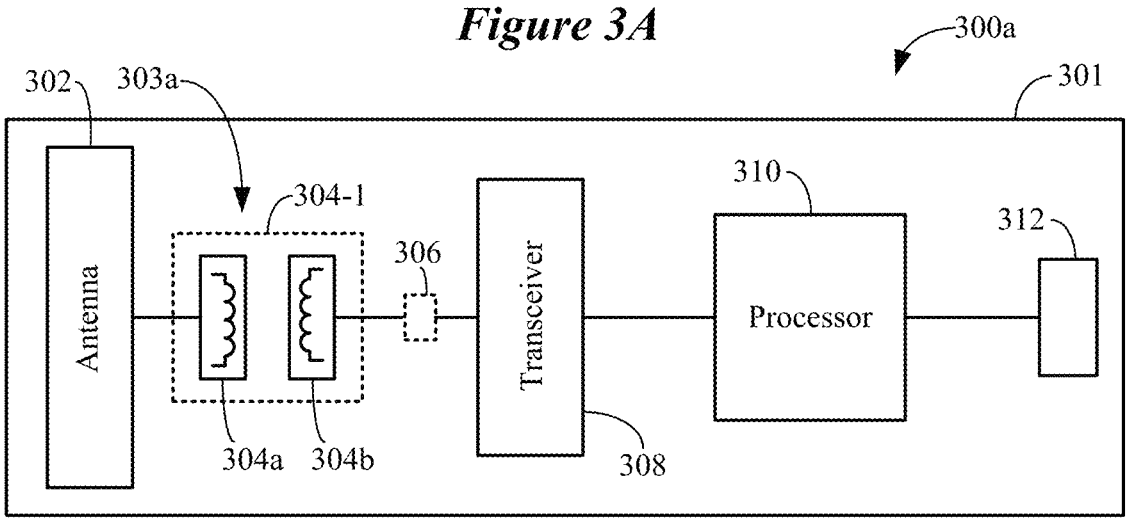
FIG. 3A illustrates a hearing device which incorporates an antenna and a magnetically coupled feed arrangement in accordance with any of the embodiments disclosed herein.

FIG. 3A illustrates a hearing device which incorporates an antenna and a magnetically coupled feed arrangement in accordance with any of the embodiments disclosed herein. The hearing device 300*a* shown in FIG. 3A includes an enclosure 301 within which various components are housed. The hearing device 300*a* includes an antenna 302 operably coupled to a transceiver 308 via a magnetically coupled feed arrangement 303*a*. The transceiver 308 is coupled to a processor 310, and a speaker or receiver 312 is also coupled to the processor 310. In some embodiments, the hearing device 300*a* includes one or more microphones. The magnetically coupled feed arrangement 303*a* comprises a transformer 304-1. The transformer 304-1 includes a first coil

304*a*, coupled to the antenna 302, and a second coil 304*b*, operably coupled to the transceiver 308. In some embodiments, the second coil 304*b* is coupled to a matching network 306, and the matching network 306 is coupled to the transceiver 308. The transformer 304-1 defines a connection-less (no physical connection) feed for the antenna 302. In some embodiments, the transformer 304-1 need not be a separable transformer.

Figure 3B:
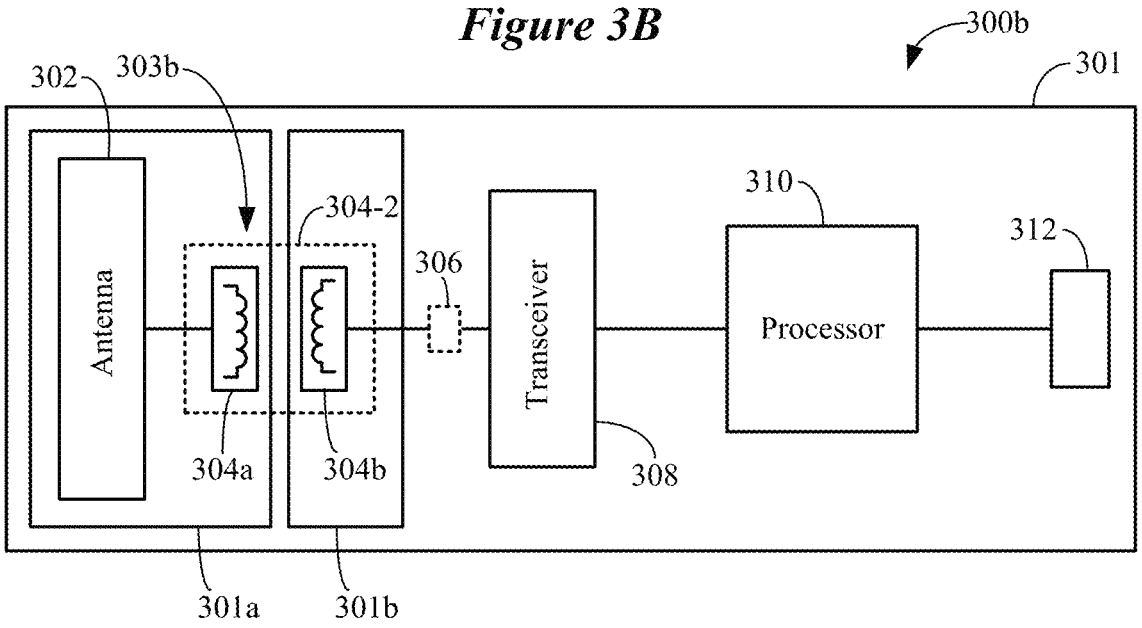
FIG. 3B illustrates a hearing device which incorporates an antenna and a magnetically coupled feed arrangement in accordance with any of the embodiments disclosed herein.

The antenna 302 and the first and second coils 304*a*, 304*b* shown in FIGS. 3A and 3B can be disposed on rigid or flexible substrates (or a combination of rigid and flexible substrates). For example, the first and second coils 304*a*, 304*b* can each be disposed on a flexible printed circuit board substrate or a rigid printed circuit board substrate. In another example, one of the first and second coils 304*a*, 304*b* can be disposed on a flexible printed circuit board substrate, and the other of the first and second coils 304*a*, 304*b* can be disposed on a rigid printed circuit board substrate. In each of these examples, the antenna 302 can be disposed on a flexible printed circuit board substrate or a rigid printed circuit board substrate. For example, the antenna 302 and the first and second coils 304*a*, 304*b* can be disposed on flexible printed circuit board substrates. By way of further example, the antenna 302 and the first coil 304*a* can be disposed on a rigid printed circuit board substrate, and the second coil 304*b* can be disposed on a flexible printed circuit board substrate.

FIG. 3B illustrates a variation of the hearing device shown in FIG. 3A. In the embodiment shown in FIG. 3B, the hearing device 300*b* includes an enclosure 301 comprising a movable section 301*a*. The movable section 301*a* represents a component or structure which is movable relative to a fixed section 301*b* of the enclosure 301. For example, the movable section 301*a* can be a battery door or drawer supported by a faceplate of the enclosure 301. The fixed section 301*b* can be a flexible electrical circuit, a spine, a wall of the enclosure 301, or other structure or component of the enclosure 301 that remains relatively fixed when the movable section 301*a* is displaced relative to the fixed section 301*b* (e.g., via manipulation by the wearer's fingers).

The hearing device 300*a* shown in FIG. 3B includes a magnetically coupled feed arrangement 303*b* operably coupled to the antenna 302 and the transceiver 308 (e.g., optionally via the matching network 306). The magnetically coupled feed arrangement 303*b* comprises a separable transformer 304-2. The separable transformer 304-2 includes a first coil 304*a* and a second coil 304*b* which are movable relative to one another. The antenna 302 and the first coil 304*a* are mounted to or supported by the movable section 301*a*. The second coil 304*b* is mounted to or supported by the fixed section 301*b*. The first coil 304*a* can be moved away from the second coil to assume a de-coupled configuration, during which the antenna 302 and transceiver 308 are non-operable for effecting wireless communication. The first coil 304*a* and second coil 304*b* can be moved into close proximity with one another to assume a magnetically coupled configuration, during which the antenna 302 and transceiver 308 are operable for effecting wireless communication.

Figure 4A:
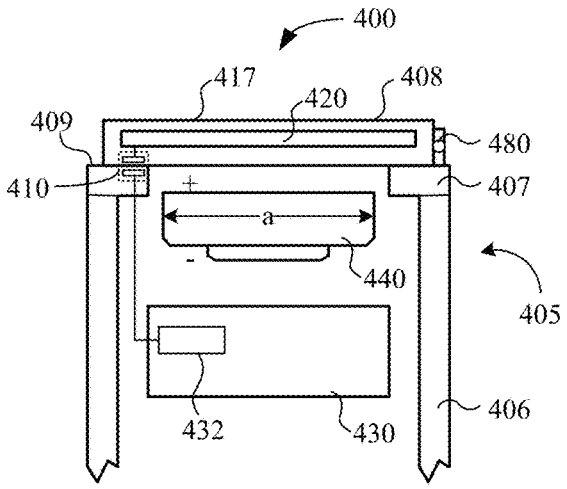
FIGS. 4A through 4C illustrate an antenna and a coupling element of a magnetically coupled feed arrangement mounted on a battery door of a hearing device faceplate in accordance with any of the embodiments disclosed herein.
Figure 4B:
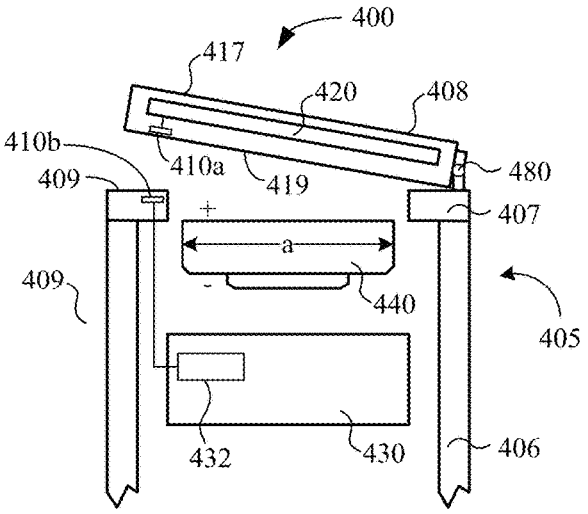
Figure 4C:
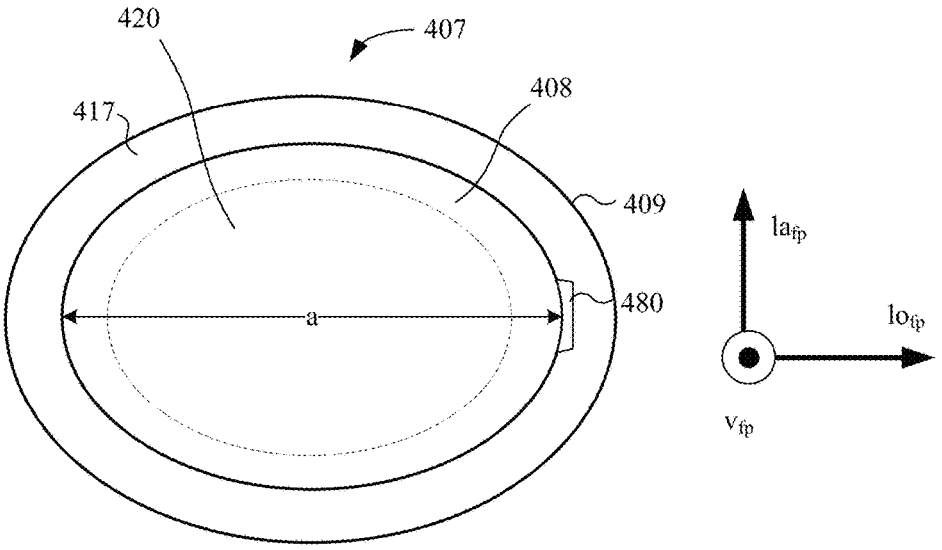

FIGS. 4A through 4C illustrate an antenna and a coupling element of a magnetically coupled feed arrangement mounted on a battery door of a hearing device faceplate in accordance with any of the embodiments disclosed herein. FIGS. 4A through 4C illustrate portions of a hearing device 400 including an enclosure 405 comprising a portion of a shell 406 and a faceplate 407. The faceplate 407 comprises a faceplate peripheral region 409 and a battery door 408. A battery 440 and electronics 430 are shown disposed within the shell 406. The battery 440 is accessible through the battery door 408. As illustrated in FIG. 4B, a hinge 480 connects the battery door 408 to the faceplate peripheral region 409 allowing the battery door 408 to rotate open or closed for accessing the battery 408.

FIG. 4C provides a top view of the faceplate 407 including the faceplate peripheral region 409, battery door 408, and hinge 480. As best seen in the top view of FIG. 4C, the faceplate 407 can be approximated by an ellipse or oval although other shapes are contemplated. The faceplate 407 extends generally along a longitudinal axis $lof_p$ and a lateral axis $laf_p$, where $lof_p$ is the longest dimension of the faceplate 407 and $laf_p$ is orthogonal to $lof_p$. Axes $lof_p$ and $laf_p$ define the plane of the faceplate 407. The vertical axis, $vf_p$, of the faceplate extends through the faceplate and is orthogonal to $lof_p$ and $laf_p$. The battery 440 may also be generally in the shape of an ellipse, oval or other suitable shape and may be oriented such a major surface of the battery lies substantially parallel to a plane formed by the longitudinal and lateral axes of the faceplate 407. In some embodiments, the ground (−) side of the battery 440 faces toward the user's ear drum and the positive (+) side of the battery 440 faces away from the user's ear drum (indicated in FIG. 4A). Alternatively, the battery may be arranged differently in the enclosure, e.g., in the opposite orientation or a major surface of the battery may be arranged substantially perpendicular to the plane of the faceplate.

As shown in FIGS. 4A through 4C, the antenna 420 can be disposed in or on the battery door 408 of the hearing device 400. For example, the antenna 420 may be molded within or on the battery door 408 or attached to a surface of the battery door 408, e.g., using an adhesive. In some embodiments, the antenna 420 can be formed as a laser direct structuring (LDS) component on the battery door 408. A protective coating can be applied to the exterior surface of the antenna 420. In other embodiments, the antenna 420 and the battery door 408 may be formed as a unitary piece. For example, in some embodiments, the antenna 420 may be coated with a material that hardens over time or with exposure to certain stimuli, and the coated antenna serves as the battery door 480. As another example, the antenna 420 can be molded into the battery door 408 in some implementations.

The antenna 420 can be arranged such that the plane of the antenna extends along the plane of the faceplate 407. In some embodiments, the plane of the antenna 420 may be substantially parallel or at a slight angle with respect to the plane of the faceplate 407. The antenna 420 may be implemented as a Planar Inverted-F Antenna (PIFA), as illustrated in connection with FIGS. 7-8. When the antenna 420 is configured as a PIFA, the patch (radiating element) and ground plane may be arranged to extend along the plane of the faceplate 407.

When the battery 440 is arranged in the enclosure 405 such that the plane, a, of the battery 440 lies substantially along the plane of the faceplate 407, the battery door 408 provides a relatively large area for the antenna 420 at a location where mechanical interference from other structures and/or electromagnetic interference from the device electronics is reduced or eliminated. The hearing device 400 is configured to be inserted within the user's ear canal with the external surface 417 of the faceplate 407 facing away from the wearer's ear drum (e.g., towards the pinna). When properly inserted within the wearer's ear canal, and depending on the configuration of the hearing device 400, the faceplate 407 may reside entirely within the ear canal, extend out of the ear canal, or be located close to the opening of the ear canal. Locating the antenna 420 in, on, or near the faceplate 407 serves to reduce loading of the electromagnetic signal caused by the wearer's head. In the arrangements shown in FIGS. 4A through 4C, the battery 440 may provide a shield for the antenna 420. The shield provided by the battery 440 may achieve further reduction in electromagnetic interference generated by the hearing device electronics 430 that may affect signals on the antenna 420.

As is further shown in FIGS. 4A and 4B, the antenna 420 is operatively coupled to a transceiver 432 of the electronics 430 via a magnetically coupled feed arrangement 410. The magnetically coupled feed arrangement 410 includes a separable transformer comprising a first coil 410*a* and a second coil 410*b*. The first coil 410*a* is mounted on an interior surface 419 of the battery door 408. The second coil 410*b* is shown mounted on the peripheral region 409 of the faceplate 407. As was discussed previously, the second coil 410*b* can be mounted on or supported by other structures or components within the shell 406 (e.g., a flexible electrical circuit, a spine structure, a shell wall).

When the battery door 408 is in a closed configuration (see FIG. 4A), the first and second coils 410*a*, 410*b* are in close proximity to one another, which together serve as a magnetically coupled feed for the antenna 420. When the battery door 408 is in an open configuration (see FIG. 4B), the first and second coils 410*a*, 410*b* are separated from one another and no longer magnetically coupled.

Figure 5:
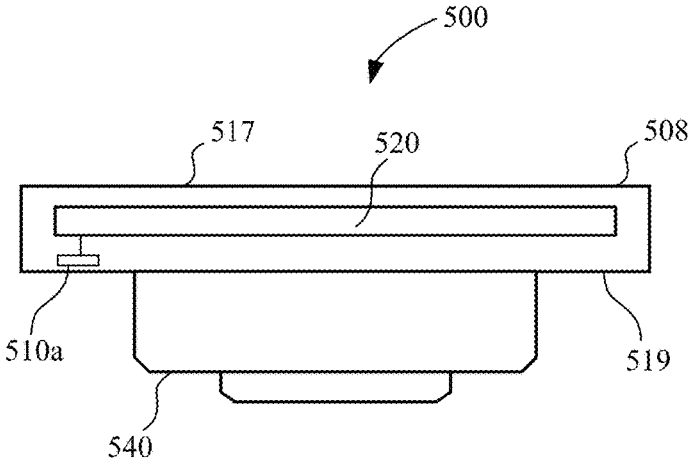
FIG. 5 illustrates an integrated antenna/battery door module in accordance with any of the embodiments disclosed herein.

FIG. 5 illustrates an integrated antenna/battery door module in accordance with any of the embodiments disclosed herein. The antenna/battery door module 500 shown in FIG. 5 includes a battery door 508 having an exterior surface 517 and an opposing interior surface 519. A battery 540 is affixed to the interior surface 519 of the battery door 508. An antenna 520 is attached to the battery door 508 in a manner previously described. In some embodiments, the antenna 520 is implemented as a PIFA. A first coil 510*a* of a separable transformer is connected to the antenna 520 and disposed on the inner surface 519 of the battery door 508. When the antenna/battery door module 500 is attached to the faceplate of a hearing device and moved to its closed configuration, the first coil 510*a* aligns with and magnetically couples to a corresponding second coil (not shown) disposed on the faceplate or other support structure/component on or within the shell of the hearing device. The antenna/battery module 500 can be implemented as a field replaceable module (e.g., attachable to and detachable from the faceplate hinge by the wearer, a technician or a hearing instrument professional).

Figure 6:
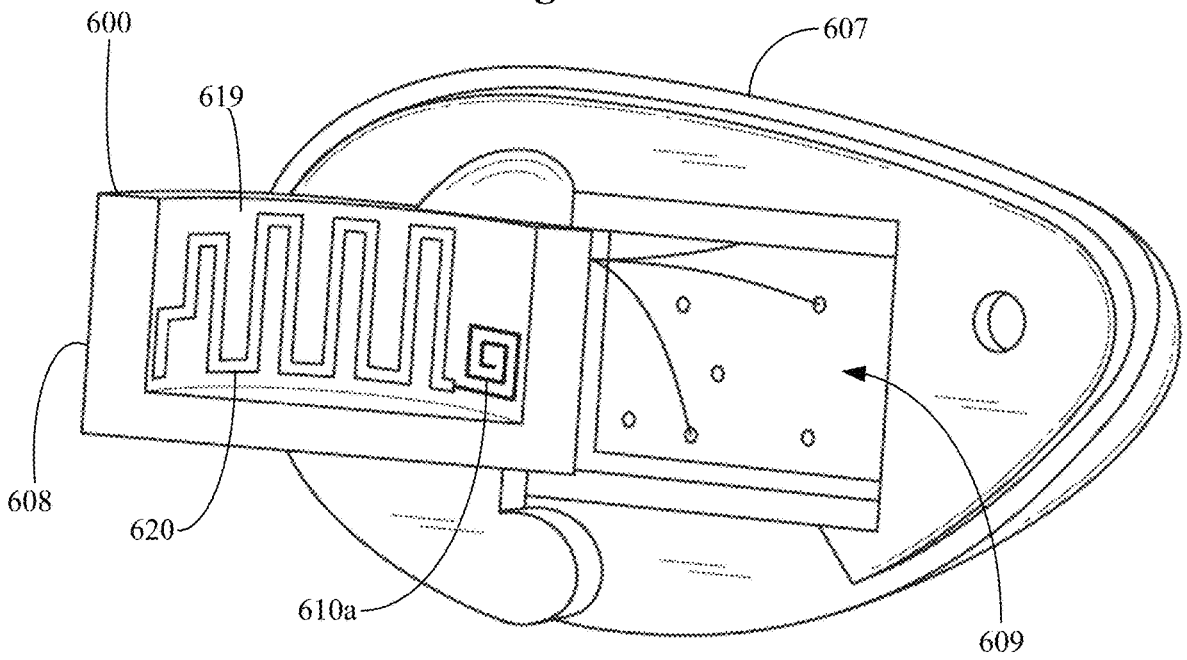
FIG. 6 illustrates an integrated antenna/battery door module in accordance with any of the embodiments disclosed herein.

FIG. 6 illustrates an integrated antenna/battery door module in accordance with other embodiments. The antenna/battery door module 600 shown in FIG. 6 includes a battery door 608 which supports an antenna 620 and a first coil 610*a* of a separable transformer connected to the antenna 620. The antenna/battery door module 600 is shown attached to a faceplate 607 by a hinge, and is depicted in its open configuration relative to an opening 609 of the faceplate 607. The antenna 620 is shown disposed on an inner surface 619 of the battery door 608. In the embodiment shown in FIG. 6, the antenna 620 is implemented as a meandered monopole. The first coil 610*a* is configured as a square loop connected to one end of the meandered monopole 620. When the antenna/battery door module 600 is moved to its closed configuration, the first coil 610*a* aligns with and magnetically couples to a corresponding second coil (e.g., a corresponding square loop) disposed on or supported by the faceplate 607 or other support structure or component on or within the shell of the hearing device. The antenna/battery module 600 can be implemented as a field replaceable module, in which case the battery can be a rechargeable battery.

Figure 7A:
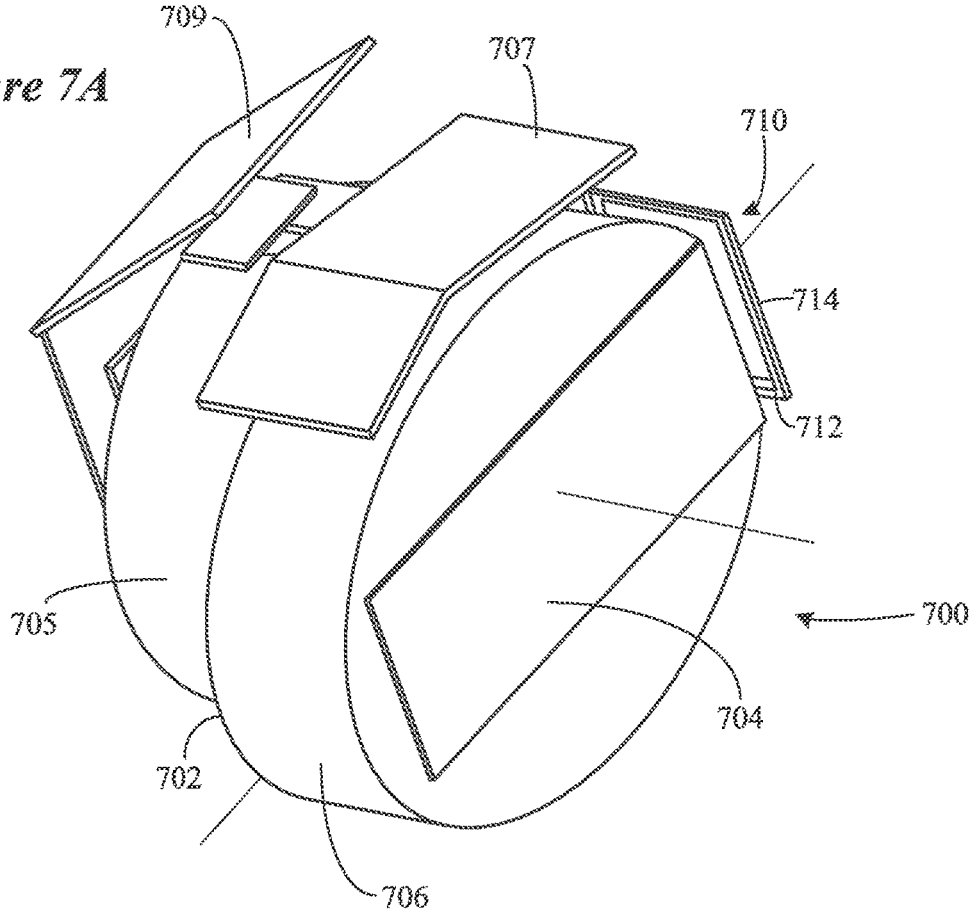
FIGS. 7A and 7B illustrate an antenna and a magnetically coupled feed arrangement in accordance with any of the embodiments disclosed herein.
Figure 7B:
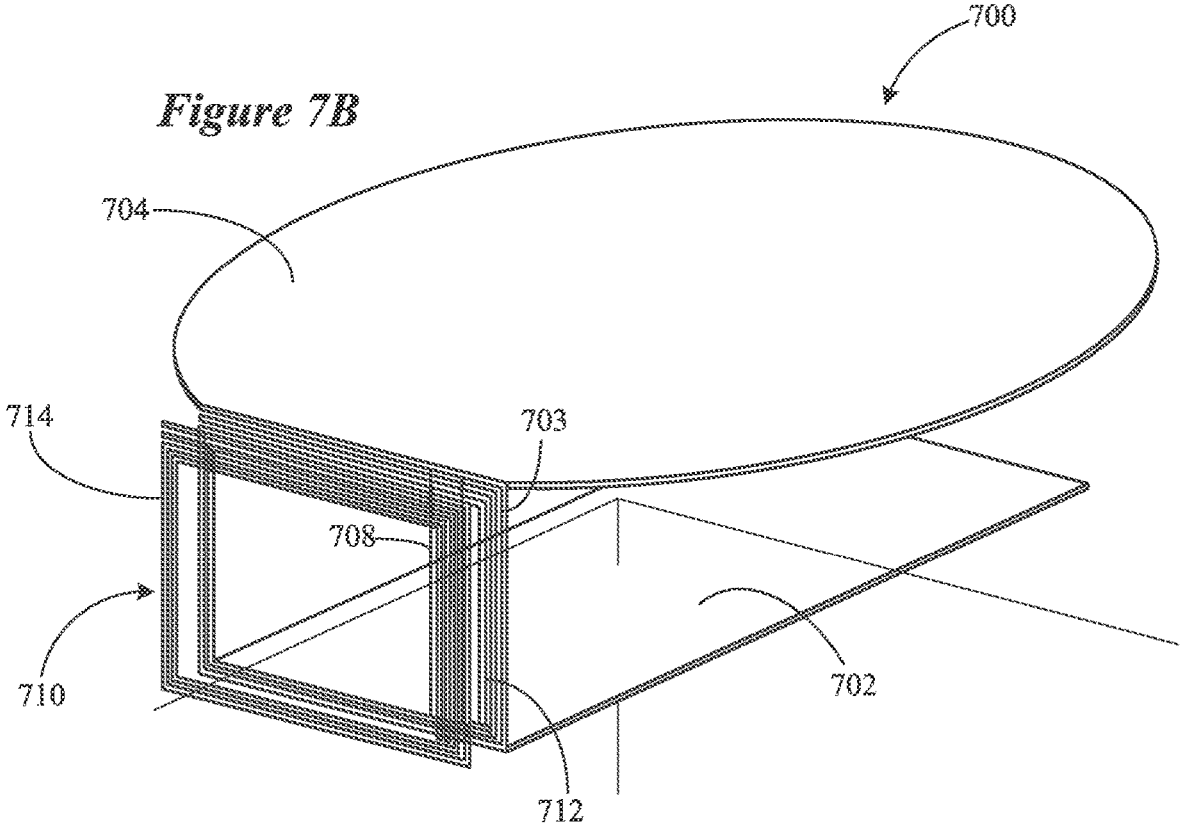

FIGS. 7A and 7B illustrate an antenna and a magnetically coupled feed arrangement in accordance with any of the embodiments disclosed herein. In FIG. 7A, the antenna 700 is shown positioned adjacent a battery 705 (e.g., a 13 or 312 battery, which can be a rechargeable battery). The antenna 700 and battery 705 are electrically connected to other components of the hearing device (e.g., radio transceiver, power management circuitry) via flexible electrical circuits (PCB flex) 707 and 709.

The antenna 700 shown in FIGS. 7A and 7B is representative of a patch-type antenna. Patch antennas, also referred to as rectangular microstrip antennas, are low profile and lightweight making them well-suited for use in ear-worn electronic devices, such as hearing aids and other hearables. Various types of patch antennas can be implemented within a hearing device, including a PIFA and an Inverted-F Antenna (IFA). The patch-type antenna shown in FIGS. 7A and 7B is implemented as a PIFA for purposes of illustration.

The antenna 700 includes a ground plane 702 separated from a conductive patch 704 by a dielectric 706. A suitable PCB material for the dielectric 706 can have an isotropic dielectric constant in a range of about 12 to about 13, for example (e.g., TMM13i available from Rogers Corporation). Materials with a dielectric constant in this range or greater are useful to reduce the physical dimensions of the antenna 700 when compared, for example, to the physical dimensions of an antenna that uses air as the dielectric. The antenna 700 includes a shorting wall, frame or pin 703 that shorts the patch 704 to the ground plane 702. To achieve a desired antenna response, the antenna 700 may include multiple shorting pins, for example.

The antenna 700 is fed by a magnetically coupled feed arrangement 710 which includes a first coil 712 and a second coil 714. In FIGS. 7A and 7B, the magnetically coupled feed arrangement 710 is oriented in a plane transverse (e.g., normal) to a plane of the patch 704 and ground plane 702. The first coil 712 is connected to a feed arm 708 of the antenna 700. The second coil 714 is coupled to a radio transceiver of the hearing device either directly or via a matching network. The first and second coils 712, 714 are shown as having a substantially planar configuration (e.g., a flat rectangular or square configuration), and are in close proximity and substantially parallel to one another. In this orientation, the first and second coils 712, 714 are configured to feed the antenna 700 via mutual induction between the first and second coil 712, 714.

The antenna 700 and first coil 712 can be mounted to a first structure or component of the hearing device, and the second coil 714 can be mounted to a second structure or component of the hearing device. In some implementations, the first structure or component supporting the antenna 700 and first coil 712 is movable relative to the structure or component supporting the second coil 714. In other implementations, the structure or component supporting the second coil 714 is movable relative to the structure or component supporting the antenna 700 and first coil 712. In further implementations, the first and second structures or components are static structures or components of the hearing device.

By way of example, the antenna 700 and first coil 712 can be mounted on a movable battery door or drawer supported by a faceplate of the hearing device. The second coil 714 can be mounted to a fixed structure or component within the shell of the hearing device. When the battery door is closed, the first and second coils 712, 714 are substantially parallel to one another, allowing the antenna 700 to be fed via mutual induction between the first and second coil 712, 714. When the battery door is open, the first and second coils 712, 714 are moved apart from one another (e.g., move substantially non-parallel to one another), which prohibits or inhibits mutual induction between the first and second coils 712, 714.

Figure 8A:
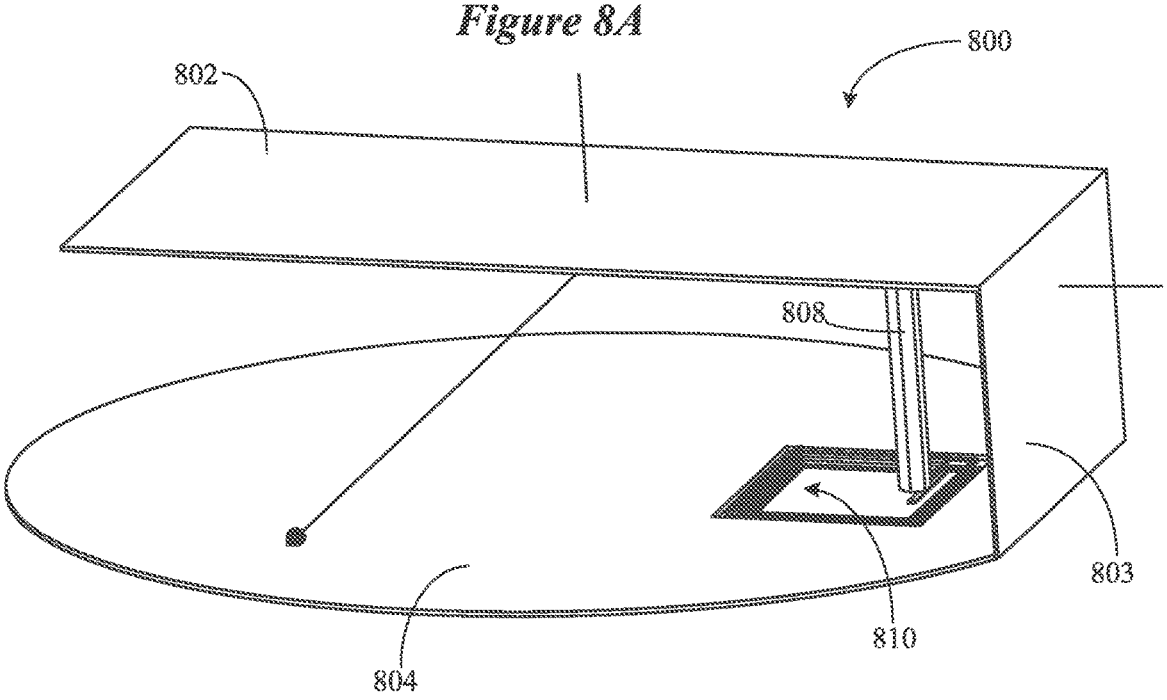
FIGS. 8A and 8B illustrate an antenna and a magnetically coupled feed arrangement in accordance with any of the embodiments disclosed herein.
Figure 8B:
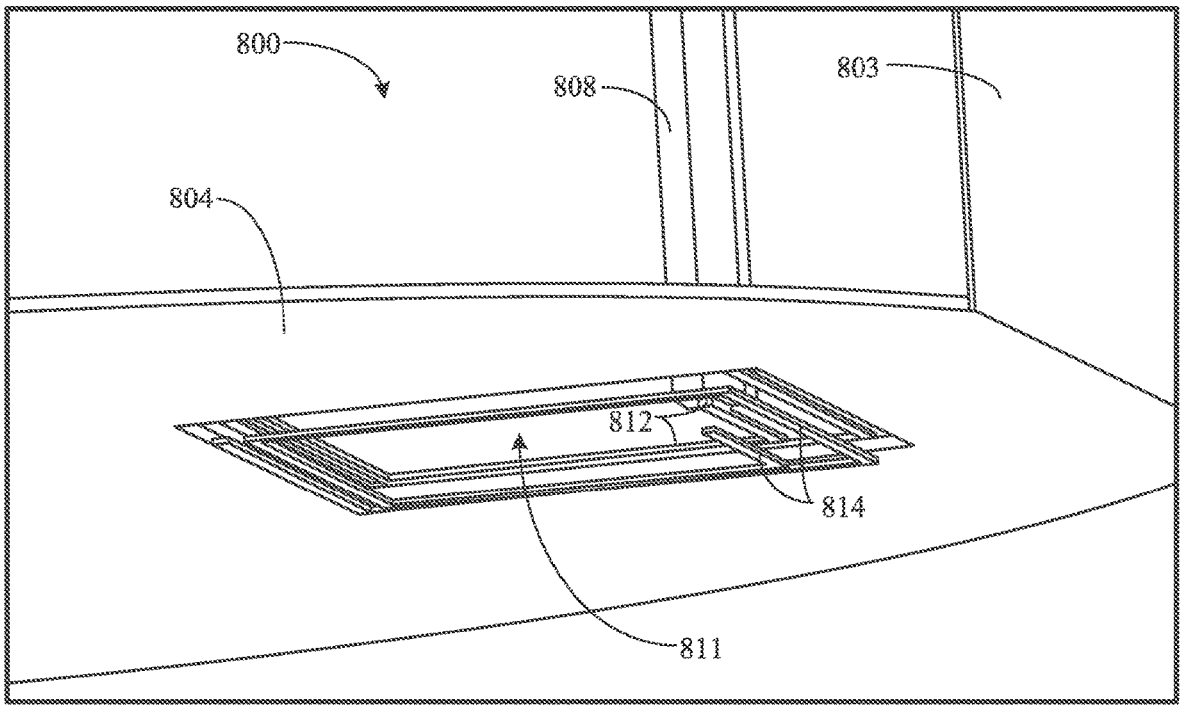

FIGS. 8A and 8B illustrate an antenna and a magnetically coupled feed arrangement in accordance with any of the embodiments disclosed herein. The antenna 800 shown in FIGS. 8A and 8B is implemented as a PIFA. The antenna 800 includes a conductive patch 802 separated from a ground plane 804 by a dielectric (not shown, but see FIG. 7A). The antenna 800 includes a shorting wall 803 (which may be a shorting pin) that shorts the patch 802 to the ground plane 804. The antenna 800 is fed by a magnetically coupled feed arrangement 810 which includes a first coil 812 and a second coil 814. In FIGS. 8A and 8B, the magnetically coupled feed arrangement 810 is positioned in a void 811 provided in the ground plane 804, and is oriented in a plane parallel to a plane of the ground plane 802.

The first coil 812 is connected to a feed arm 808 of the antenna 800. The second coil 814 is coupled to a radio transceiver of the hearing device either directly or via a matching network. The first and second coils 812, 814 are shown as having a planar configuration (e.g., a flat rectangular or square configuration), and are in close proximity and substantially parallel to one another. In this orientation, the first and second coils 812, 814 are configured to feed the antenna 800 via mutual induction between the first and second coil 812, 814.

The antenna 800 and first coil 812 can be mounted to a first structure or component of the hearing device, and the second coil 814 can be mounted to a second structure or component of the hearing device. In some implementations, the first structure or component supporting the antenna 800 and first coil 812 is movable relative to the structure or component supporting the second coil 814. In other implementations, the structure or component supporting the second coil 814 is movable relative to the structure or component supporting the antenna 800 and first coil 812. In further implementations the first and second structures or components are static structures or components of the hearing device.

By way of example, the antenna 800 and first coil 812 can be mounted on a movable battery door or drawer supported by a faceplate of the hearing device. The second coil 814 can be mounted to a fixed structure or component within the shell of the hearing device. When the battery door is closed, the first and second coils 812, 814 are substantially parallel to one another, allowing the antenna 800 to be fed via mutual induction between the first and second coil 812, 814. When the battery door is open, the first and second coils 812, 814 are moved apart from one another (e.g., move substantially non-parallel to one another), which prohibits or inhibits mutual induction between the first and second coils 812, 814.

Figure 9A:
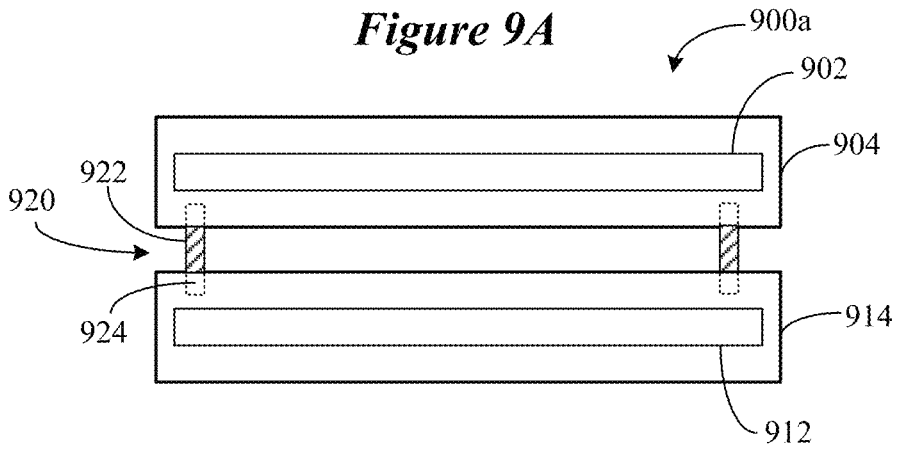
FIG. 9A illustrates a magnetically coupled feed arrangement in accordance with any of the embodiments disclosed herein.

FIG. 9A illustrates a magnetically coupled feed arrangement in accordance with any of the embodiments disclosed herein. The magnetically coupled feed arrangement 900*a* includes a first coil 902 disposed on a first substrate 904, and a second coil 912 disposed on a second substrate 914. The first and second substrates 904, 914 can be rigid or flexible substrates (e.g., rigid or flexible PCB substrates). The magnetically coupled feed arrangement 900*a* includes one or more alignment features 920 configured to facilitate alignment between the first and second coils 902, 912 when the first and second substrates 904, 914 are moved into close proximity. The alignment features 920 can include a peg 922 and hole 924 arrangement, whereby alignment between the first and second coils 902, 912 is achieved when one or more pegs 922 are received by one or more holes 924. Other types of alignment features 920 are contemplated, such as a ridge and groove arrangement provided on the opposing surfaces of the first and second substrates 904, 914.

Figure 9B:
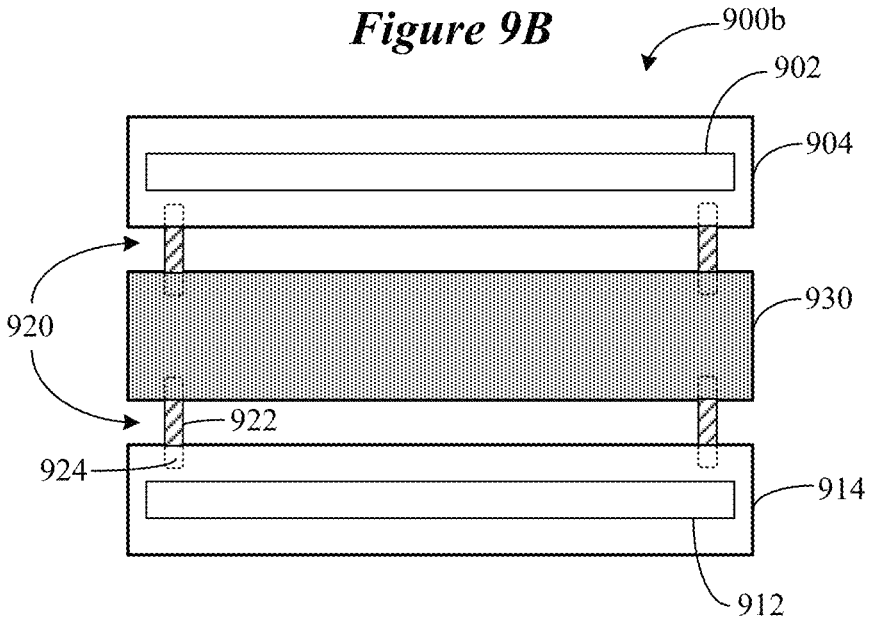
FIG. 9B illustrates a magnetically coupled feed arrangement in accordance with any of the embodiments disclosed herein.

FIG. 9B illustrates a variation of the magnetically coupled feed arrangement shown in FIG. 9A. In FIG. 9B, the magnetically coupled feed arrangement 900*b* includes a substrate 930 disposed between the first and second coils 902, 912 supported by the first and second substrates 904, 914, respectively. The substrate 930 is configured to increase magnetic coupling between the first and second coils 902, 912. For example, the substrate 930 can comprise high permeability material, such as Mu-Metal, ferrite, or ferrite loaded elastomer. The magnetically coupled feed arrangement 900*b* includes one or more alignment features 920 configured to facilitate alignment between the first and second coils 902, 912 when the first and second substrates 904, 914 are moved in to close proximity with the substrate 930. The substrate 930 can be affixed to one of the first and second substrates 904, 914 or be supported by a structure or component separate from the first and second substrates 904, 914. The alignment features 920 can be the same as those discussed hereinabove (e.g., one or more pegs 922 received by one or more holes 924).

Figure 10:
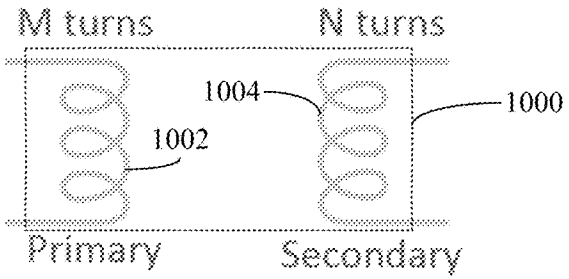
FIG. 10 illustrates a magnetically coupled feed arrangement in accordance with any of the embodiments disclosed herein.

FIG. 10 illustrates a magnetically coupled feed arrangement in accordance with any of the embodiments disclosed herein. The magnetically coupled feed arrangement 1000 includes a primary coil 1002 and a secondary coil 1004 which define components of a transformer, such as a separable transformer discussed previously. The primary coil 1002 is typically coupled to a radio transceiver (e.g., source) of the hearing device, and the secondary coil 1004 is typically coupled to the antenna (e.g., load) of the hearing device. The primary coil 1002 comprises windings having M turns, and the secondary coil 1004 comprises windings having N turns. According to some embodiments, M and N are selected to enhance impedance matching between the transceiver and the antenna of the hearing device. The relationship between M and N turns can be characterized by the formula: Turns Ratio $(M:N)=\sqrt{(R_{source}/R_{load})}$, with the smaller number of turns being on the side with lower impedance. It is noted that complex impedances can also be transformed according to the formula $Z_1=Z_2/(M/N)^2$, where $Z_1$ is the source impedance and $Z_2$ is the load impedance.

FIGS. 11A through 11D illustrate variations of a magnetically coupled feed arrangement which incorporates impedance matching components in accordance with any of the embodiments disclosed herein. Each of the magnetically coupled feed arrangements 1100*a*-1100*d* includes a primary coil 1102 and a secondary coil 1104 which define components of a transformer, such as a separable transformer. As discussed previously, the primary coil 1102 is typically coupled to a radio transceiver (e.g., source) of the hearing device, and the secondary coil 1104 is typically coupled to the antenna (e.g., load) of the hearing device. As the transformer coils 1102, 1104 are inductive components, impedance matching can be accomplished using capacitors on the ends of the transformer coils 1102, 1104. These capacitors, referred to as tuning capacitors, can be incorporated in series or in shunt (in parallel).

The tuning capacitors incorporated in the magnetically coupled feed arrangements 1100*a*-1100*d* provide for a tuned transformer (both input and output being tuned to resonance) that typically has much higher coupling than an untuned transformer. This is especially true if the Q of the tuned LCR circuits is high, and if the mutual inductance of the two coils 1102, 1104 is not near 1. For the transformers shown in FIGS. 11A-11D, a first tuning capacitor, C1, is coupled to the primary coil 1102, and a second tuning capacitor, C2, is coupled to the secondary coil 1104. The first tuning capacitor, C1, can have a capacitance selected to achieve resonance with the primary coil 1102. The second tuning capacitor, C2, can have a capacitance selected to achieve resonance with the secondary coil 1104.

Figure 11A:
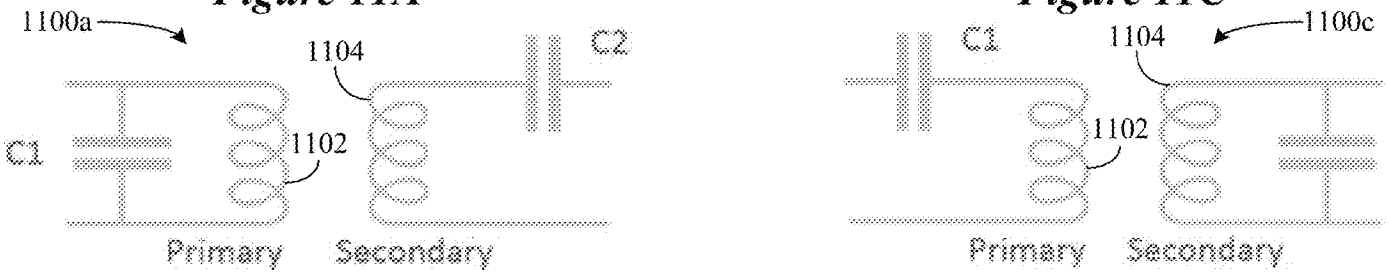
FIGS. 11A through 11D illustrate variations of a magnetically coupled feed arrangement which incorporates impedance matching components in accordance with any of the embodiments disclosed herein.
Figure 11B:
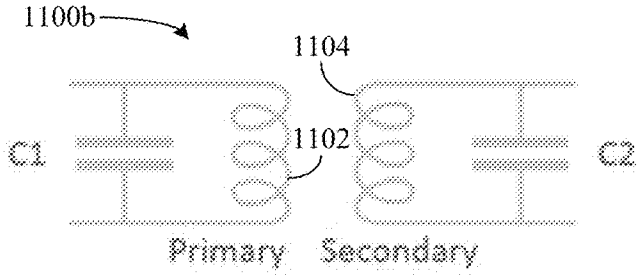
Figure 11C:
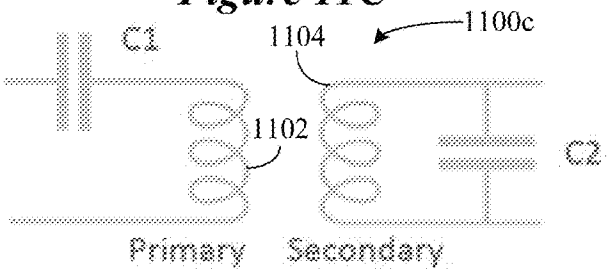
Figure 11D:
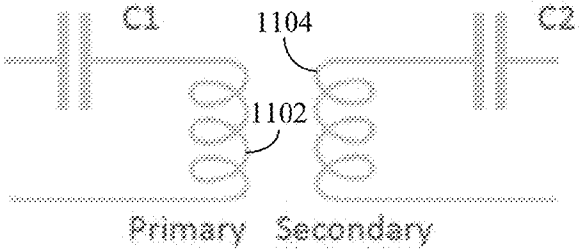

FIGS. 11A-11D illustrate four representative impedance matching configurations. In FIG. 11A, capacitor C1 is connected to the ends of the primary coil 1102 in shunt, and capacitor C2 is connected to an end of the secondary coil 1104 in series. In FIG. 11B, capacitor C1 is connected to the ends of the primary coil 1102 in shunt, and capacitor C2 is connected to the ends of the second coil 1104 in shunt. In FIG. 11C, capacitor C1 is connected to an end of the primary coil 1102 in series, and capacitor C2 is connected to ends of the secondary coil 1104 in shunt. In FIG. 11D, capacitor C1 is connected to an end of the primary coil 1102 in series, and capacitor C2 is connected to an end of the secondary coil 1104 in series. It is noted that impedance matching can be enhanced by incorporating the tuning capacitors illustrated in FIGS. 11A-11D in combination with appropriate selection of the number of turns (M and N) of the windings of the primary and secondary coils 1102, 1104.

Figure 12B:
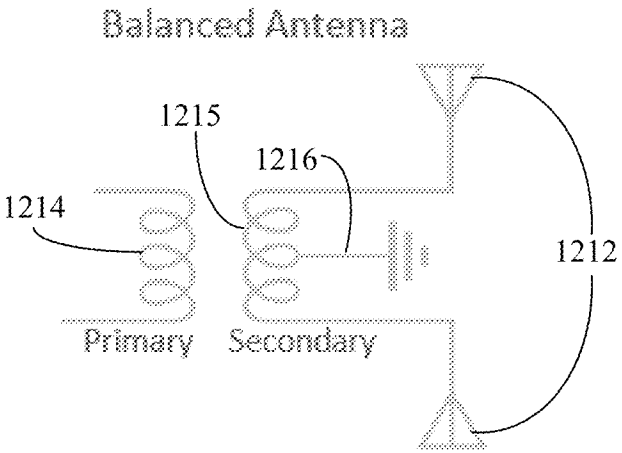
FIG. 12B illustrates a balanced antenna of a hearing device which can be interfaced with an unbalanced RF port of a radio transceiver via a balun in accordance with any of the disclosed embodiments.
Figure 12A:
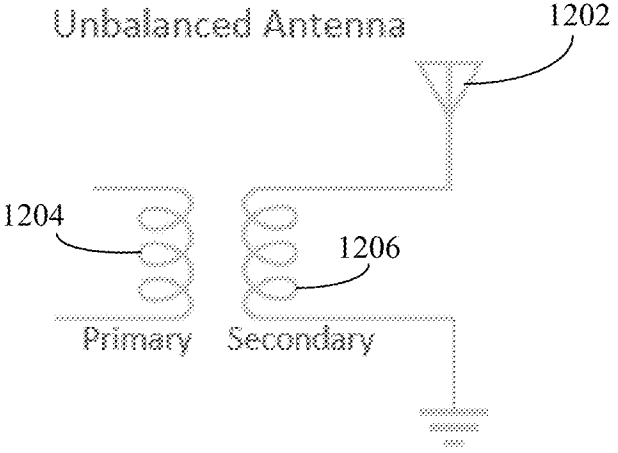
FIG. 12A illustrates an unbalanced antenna of a hearing device which can be interfaced with a balanced RF port of a radio transceiver via a balun in accordance with any of the disclosed embodiments.

A magnetically coupled feed arrangement can incorporate a balun in accordance with any of the embodiments disclosed herein. In general terms, a balun can be considered a type of transformer that is used to convert an unbalanced signal to a balanced signal or vice a versa. A balun can be integrated into the magnetically coupled feed arrangement to interface a balanced RF port (e.g., primary coupling port 1204) of a radio transceiver to an unbalanced antenna (e.g., antenna 1202 coupled to secondary coupling port 1206), such as that shown in FIG. 12A. Alternatively, a balun can be integrated into the magnetically coupled feed arrangement to interface an unbalanced RF port (e.g., primary coupling port 1214) of the transceiver with a balanced antenna (e.g., antenna 1212 coupled to secondary coupling port 1216), such as that illustrated in FIG. 12B. According to one embodiment, a balun can include an inductive feed-line coupler, which is a particular type of RF transformer, having a center-tap 1216 connected to ground on the balanced circuit side (e.g., see FIG. 12B). It is noted that an N:M turns ratio balun can be used as a combination balun/impedance-transformer/magnetic feed-line coupler according to some embodiments.

This document discloses numerous embodiments, including but not limited to the following:

Item 1 is an ear-worn electronic device configured to be worn by a wearer, comprising:
- an enclosure configured for at least partial insertion into an ear canal of the wearer, the enclosure comprising a preformed shape or a shapeable material that conforms to a shape of the wearer's ear canal, the enclosure comprising a faceplate and a battery door supported by and movable relative to the faceplate;
- a processor disposed in the enclosure;
- a speaker or a receiver operably coupled to the processor;
- a radio frequency transceiver disposed in the enclosure and operably coupled to the processor; and
- an antenna supported by or integral to the battery door; and
- a magnetically coupled feed arrangement comprising a separable transformer, the separable transformer comprising:
  - a first coil coupled to the antenna and supported by the battery door; and
  - a second coil coupled to the transceiver and supported by the faceplate, a structure of or within the enclosure or a component in the enclosure, wherein a conductor of the second coil is physically and electrically separated from a conductor of the first coil;
  - wherein the feed arrangement is configured to feed the antenna via mutual inductance between the first and second coils.

Item 2 is the device of item 1, wherein the first coil is moveable relative to the second coil in response to opening and closing of the battery door relative to the faceplate.

Item 3 is the device of item 1, wherein:
- the first and second coils have a planar configuration; and
- the first and second coils are substantially parallel to one another when the battery door is in a closed orientation relative to the faceplate.

Item 4 is the device of item 3, wherein the first and second coils are substantially non-parallel to one another when the battery door is in an opened orientation relative to the faceplate.

Item 5 is the device of item 1, further comprising a battery, wherein the battery, the battery door, the antenna, and the first coil define a detachable battery door module.

Item 6 is the device of item 1, comprising one or more alignment features configured to facilitate alignment between the first and second coils when the battery door is in a closed orientation.

Item 7 is the device of item 1, wherein the separable transformer comprises a substrate disposed between the first and second coils, the substrate configured to increase magnetic coupling between the first and second coils.

Item 8 is the device of item 1, wherein the magnetically coupled feed arrangement comprises a balun.

Item 9 is the device of item 1, wherein:
- the first coil comprises windings having n turns;
- the second coil comprises windings having m turns; and
- n and m are selected to enhance impedance matching between the transceiver and the antenna.

Item 10 is the device of item 1, wherein:
- a first tuning capacitor is coupled to the first coil;
- a second tuning capacitor is coupled to the second coil;
- the first tuning capacitor has a capacitance selected to achieve resonance with the first coil; and
- the second tuning capacitor has a capacitance selected to achieve resonance with the second coil.

Item 11 is the device of item 1, wherein the first and second coils are disposed on flexible printed circuit board substrates.

Item 12 is the device of item 1, wherein the antenna, the first coil, and the second coil are disposed on flexible printed circuit board substrates.

Item 13 is the device of item 1, wherein:
- the antenna and the first coil are disposed on a rigid printed circuit board substrate; and
- the second coil is disposed on a flexible printed circuit board substrate.

Item 14 is the device of item 1, wherein the antenna comprises a patch-type antenna.

Item 15 is the device of item 1, wherein the antenna comprises a meandered monopole.

Item 16 is the device of item 1, wherein the antenna comprises an Inverted-F antenna.

Item 17 is an ear-worn electronic device configured to be worn by a wearer, comprising:

an enclosure configured for at least partial insertion into an ear canal of the wearer, the enclosure comprising a faceplate and a shell having a preformed shape or comprising a shapeable material that conforms to a shape of the wearer's ear canal;

a processor disposed in the enclosure;

a speaker or a receiver operably coupled to the processor;

a radio frequency transceiver disposed in the enclosure and operably coupled to the processor; and an antenna supported by or integral to the faceplate, the antenna comprising:

a radiating element;

a ground plane; and a substrate comprising dielectric material disposed between the radiating element and the ground plane; and a magnetically coupled feed arrangement comprising a separable transformer, the separable transformer comprising:

a first coil coupled to the antenna and supported by the faceplate; and a second coil coupled to the transceiver and supported by the faceplate, a structure of or within the shell or a component in the shell, wherein a conductor of the second coil is physically and electrically separated from a conductor of the first coil;

wherein the feed arrangement is configured to feed the antenna via mutual inductance between the first and second coils.

Item 18 is the device of item 17, wherein:

the first and second coils have a planar configuration; and the first and second coils are substantially parallel to one another.

Item 19 is the device of item 17, wherein the device is configured as an in-the-ear (ITE), in-the-canal (ITC), invisible-in-canal (IIC) or completely-in-the-canal (CIC) device.

Item 20 is an ear-worn electronic device configured to be worn by a wearer, comprising:

an enclosure configured to be supported at, by, in or on the wearer's ear;

a processor disposed in the enclosure;

a speaker or a receiver coupled to the processor;

a radio frequency transceiver disposed in the enclosure and coupled to the processor;

an antenna disposed in or on the enclosure; and a magnetically coupled feed arrangement comprising a separable transformer, the separable transformer comprising:

a first coil coupled to the antenna; and a second coil coupled to the transceiver, wherein a conductor of the second coil is physically and electrically separated from a conductor of the first coil;

wherein the feed arrangement is configured to feed the antenna via mutual inductance between the first and second coils.

Item 21 is the device of item 20, wherein at least one of the first and second coils is movable relative to the other of the first and second coils.

Item 22 is the device of item 20, wherein:

the first and second coils have a planar configuration; and the first and second coils are substantially parallel to one another.

Although reference is made herein to the accompanying set of drawings that form part of this disclosure, one of at least ordinary skill in the art will appreciate that various adaptations and modifications of the embodiments described herein are within, or do not depart from, the scope of this disclosure. For example, aspects of the embodiments described herein may be combined in a variety of ways with each other. Therefore, it is to be understood that, within the scope of the appended claims, the claimed invention may be practiced other than as explicitly described herein.

All references and publications cited herein are expressly incorporated herein by reference in their entirety into this disclosure, except to the extent they may directly contradict this disclosure. Unless otherwise indicated, all numbers expressing feature sizes, amounts, and physical properties used in the specification and claims may be understood as being modified either by the term "exactly" or "about." Accordingly, unless indicated to the contrary, the numerical parameters set forth in the foregoing specification and attached claims are approximations that can vary depending upon the desired properties sought to be obtained by those skilled in the art utilizing the teachings disclosed herein or, for example, within typical ranges of experimental error.

The recitation of numerical ranges by endpoints includes all numbers subsumed within that range (e.g. 1 to 5 includes 1, 1.5, 2, 2.75, 3, 3.80, 4, and 5) and any range within that range. Herein, the terms "up to" or "no greater than" a number (e.g., up to 50) includes the number (e.g., 50), and the term "no less than" a number (e.g., no less than 5) includes the number (e.g., 5).

The terms "coupled" or "connected" refer to elements being attached to each other either directly (in direct contact with each other) or indirectly (having one or more elements between and attaching the two elements). Either term may be modified by "operatively" and "operably," which may be used interchangeably, to describe that the coupling or connection is configured to allow the components to interact to carry out at least some functionality (for example, a radio chip may be operably coupled to an antenna element to provide a radio frequency electromagnetic signal for wireless communication).

Terms related to orientation, such as "top," "bottom," "side," and "end," are used to describe relative positions of components and are not meant to limit the orientation of the embodiments contemplated. For example, an embodiment described as having a "top" and "bottom" also encompasses embodiments thereof rotated in various directions unless the content clearly dictates otherwise.

Reference to "one embodiment," "an embodiment," "certain embodiments," or "some embodiments," etc., means that a particular feature, configuration, composition, or characteristic described in connection with the embodiment is included in at least one embodiment of the disclosure. Thus, the appearances of such phrases in various places throughout are not necessarily referring to the same embodiment of the disclosure. Furthermore, the particular features, configurations, compositions, or characteristics may be combined in any suitable manner in one or more embodiments.

The words "preferred" and "preferably" refer to embodiments of the disclosure that may afford certain benefits, under certain circumstances. However, other embodiments may also be preferred, under the same or other circumstances. Furthermore, the recitation of one or more preferred embodiments does not imply that other embodiments are not useful and is not intended to exclude other embodiments from the scope of the disclosure.

As used in this specification and the appended claims, the singular forms "a," "an," and "the" encompass embodiments having plural referents, unless the content clearly dictates otherwise. As used in this specification and the appended claims, the term "or" is generally employed in its sense including "and/or" unless the content clearly dictates otherwise.

As used herein, "have," "having," "include," "including," "comprise," "comprising" or the like are used in their open-ended sense, and generally mean "including, but not limited to." It will be understood that "consisting essentially of" "consisting of," and the like are subsumed in "comprising," and the like. The term "and/or" means one or all of the listed elements or a combination of at least two of the listed elements.

The phrases "at least one of," "comprises at least one of," and "one or more of" followed by a list refers to any one of the items in the list and any combination of two or more items in the list.

What is claimed is:

1. An ear-wearable electronic device configured to be worn by a wearer, comprising:

a shell configured for at least partial insertion into an ear canal of the wearer, the shell having a preformed shape or a shapeable material that conforms to a shape of the wearer's ear canal;

a processor disposed in the shell;

a speaker or a receiver operatively coupled to the processor;

a radio frequency transceiver disposed in the shell and operatively coupled to the processor;

an antenna arrangement comprising a first section disposed on a fixed structure of the shell and a second section disposed on a partially movable structure connected to, and at least partly external of, the shell; and a separable transformer connected to the antenna arrangement and comprising a first coil and a second coil, the first and second coils movable relative to one another between a coupled state and an uncoupled state, wherein a conductor of the second coil is ohmically separated from a conductor of the first coil, the separable transformer arranged to operatively couple the antenna arrangement to the transceiver.

2. The device of claim 1, wherein the movable structure is configured for movement in response to a manual force applied to a movable portion of the movable structure.

3. The device of claim 1, wherein the movable structure is configured for movement in response to an axially directed manual force applied to the movable structure.

4. The device of claim 1, wherein the second section of the antenna arrangement is configured to move concurrently with movement of the movable structure.

5. The device of claim 1, wherein the separable transformer is operatively coupled to the transceiver via a matching network.

6. The device of claim 1, wherein the separable transformer is disposed in the shell.

7. The device of claim 1, wherein the first coil is disposed in, or supported by, the shell.

8. The device of claim 1, wherein the first coil is disposed in, or supported by, the shell, and the second coil is supported by the moveable structure.

9. The device of claim 1, wherein:

the first and second coils have a planar configuration; and the first and second coils are substantially parallel to one another.

10. The device of claim 1, wherein the device is configured as an in-the-ear (ITE), in-the-canal (ITC), invisible-in-canal (IIC) or completely-in-the-canal (CIC) device.

11. An ear-wearable electronic device configured to be worn by a wearer, comprising:

a shell configured for insertion into an ear canal of the wearer, the shell comprising a preformed shape that conforms to a unique shape of the wearer's ear canal;

a processor disposed in the shell;

a speaker or a receiver operatively coupled to the processor;

a radio frequency transceiver disposed in the shell and operatively coupled to the processor;

an antenna arrangement comprising a first section disposed on a fixed structure of the shell and a second section disposed on a partially movable structure connected to, and at least partly external of, the shell, the movable structure configured for movement in response to a manual force applied to the movable structure; and a separable transformer disposed in, or supported by, the shell and connected to the antenna arrangement, the separable transformer comprising a first coil and a second coil, the first and second coils movable relative to one another between a coupled state and an uncoupled state, wherein a conductor of the second coil is ohmically separated from a conductor of the first coil, the separable transformer arranged to operatively couple the antenna arrangement to the transceiver;

wherein the device is configured as an in-the-ear (ITE), in-the-canal (ITC), invisible-in-canal (IIC) or completely-in-the-canal (CIC) device.

12. The device of claim 11, wherein the movable structure is configured for movement in response to a manual force applied to a movable portion of the movable structure.

13. The device of claim 11, wherein the movable structure is configured for movement in response to an axially directed manual force applied to the movable structure.

14. The device of claim 11, wherein the second section of the antenna arrangement is configured to move concurrently with movement of the movable structure.

15. The device of claim 11, wherein the separable transformer is operatively coupled to the transceiver via a matching network.

16. The device of claim 11, wherein the separable transformer is disposed in the shell.

17. The device of claim 11, wherein the first coil is disposed in, or supported by, the shell.

18. The device of claim 11, wherein the first coil is disposed in, or supported by, the shell, and the second coil is supported by the moveable structure.

19. The device of claim 11, wherein:

the first and second coils have a planar configuration; and the first and second coils are substantially parallel to one another.

* * * * *